US009932196B2

(12) United States Patent
Jiang

(10) Patent No.: US 9,932,196 B2
(45) Date of Patent: Apr. 3, 2018

(54) PACKING TAPE DISPENSER

(71) Applicant: Peigen Jiang, Sammamish, WA (US)

(72) Inventor: Peigen Jiang, Sammamish, WA (US)

( * ) Notice: Subject to any disclaimer, the term of this patent is extended or adjusted under 35 U.S.C. 154(b) by 153 days.

(21) Appl. No.: 15/200,438

(22) Filed: Jul. 1, 2016

(65) Prior Publication Data

US 2018/0002129 A1 Jan. 4, 2018

(51) Int. Cl.
*B65H 35/00* (2006.01)

(52) U.S. Cl.
CPC ..... *B65H 35/0026* (2013.01); *B65H 2405/45* (2013.01); *B65H 2601/30* (2013.01); *Y10T 225/20* (2015.04); *Y10T 225/282* (2015.04)

(58) Field of Classification Search
CPC ..... B65H 35/0026; B65H 35/0006; B65H 35/002; B65H 35/0033; B65H 35/0073; B65H 35/008; B65H 35/04; B65H 35/06; B65H 2405/45; B65H 2601/30; B65H 16/06; B26F 3/00; B26F 3/02; Y10T 225/282; Y10T 225/20; Y10T 225/201; Y10T 225/203; Y10T 225/22; Y10T 225/246; Y10T 225/257; Y10T 156/1052; Y10T 156/12; Y10T 156/13
USPC ..... 242/550
See application file for complete search history.

(56) References Cited

U.S. PATENT DOCUMENTS 2,798,551 A * 7/1957 Polster ..... B65H 35/0026 225/19
6,152,344 A * 11/2000 Jensen ..... B65H 35/0026 225/12
9,162,843 B2 * 10/2015 Yu Chen ..... B65H 35/0073
9,327,935 B2 * 5/2016 Chern ..... B65H 35/06
2009/0078733 A1 * 3/2009 Yagyu ..... B26D 5/08 225/77

* cited by examiner

*Primary Examiner* — Phong Nguyen

(57) ABSTRACT

The present invention discloses a tape dispenser which includes a body having a downward facing concave space at a bottom thereof, a cutting blade mounted to the body and positioned in the concave space with an cutting edge recessed in the concave space, a groove member being able to move vertically between a first and second location, at the first location, the groove member being partially submerged in the concave space and pocketing at least a portion the cutting blade for cutting a piece of tape, at the second location, the groove member being downwardly away from the bottom of the body for threading a piece of tape through a gap formed between the groove member and the bottom of the body, a side plate attached to an end of the groove member, the side plate being slidably accommodated in a hollowed space formed inside the body, the side plate having a slot for retaining a spring to urge the side plate to slide downwardly resulting in the groove member to move from the first location to the second location, and a stopper situated within the slot and at an upper end of the spring, the stopper being fixed to the body and preventing the side plate from being completely pulled out of the hollowed space.

17 Claims, 7 Drawing Sheets

PACKING TAPE DISPENSER

CROSS-REFERENCE TO RELATED APPLICATIONS

This application is a continuation-in-part of prior U.S. patent application Ser. No. 14/532,307, filed Nov. 4, 2014, titled "PACKING TAPE DISPENSER", the contents of which is hereby incorporated in its entirety by reference.

BACKGROUND

The present invention relates generally to dispensers for adhesive tapes, and, more particularly, to packing tape dispenser.

People that pack a large number of packages for shipping often use specialized tape dispensers, designed for sealing boxes with shipping tape using only one hand. One of such packing tape dispensers has a frame supporting a handle and a roll of tape. The frame also include a hinged level, when pushed, will force out a cutting blade over a stretch of the tape.

A common problem with conventional packing tape dispensers is that they do not cut tape very easily especially under less ideal situation due to their structural characteristics. Chief among them is that the tape is often suspended over a rather long stretch and can move. It is not easy to make a cut when an object is not well secured and can move under a push.

As such, what is desired is a packing tape dispenser that can be easily applied.

SUMMARY

The present invention discloses a tape dispenser which includes a body having a downward facing concave space at a bottom thereof, a cutting blade mounted to the body and positioned in the concave space with an cutting edge recessed in the concave space, a groove member being able to move vertically between a first and second location, at the first location, the groove member being partially submerged in the concave space and pocketing at least a portion the cutting blade for cutting a piece of tape, at the second location, the groove member being downwardly away from the bottom of the body for threading a piece of tape through a gap formed between the groove member and the bottom of the body, a side plate attached to an end of the groove member, the side plate being slidably accommodated in a hollowed space formed inside the body, the side plate having a slot for retaining a spring to urge the side plate to slide downwardly resulting in the groove member to move from the first location to the second location, and a stopper situated within the slot and at an upper end of the spring, the stopper being fixed to the body and preventing the side plate from being completely pulled out of the hollowed space.

The construction and method of operation of the invention, however, together with additional objects and advantages thereof, will be best understood from the following description of specific embodiments when read in connection with the accompanying drawings.

Figure 1:
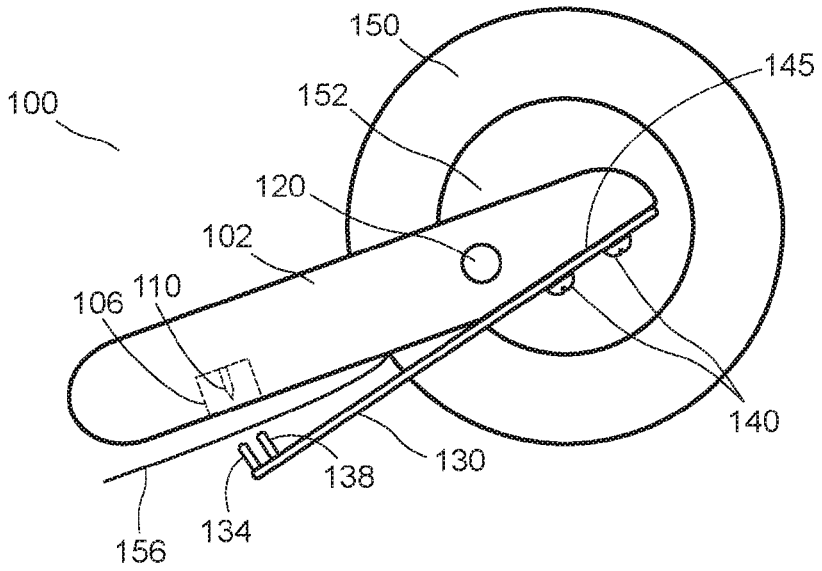
FIG. 1 is a side view of a packing tape dispenser according to an embodiment of the present invention.

The drawings accompanying and forming part of this specification are included to depict certain aspects of the invention. A clearer conception of the invention, and of the components and operation of systems provided with the invention, will become more readily apparent by referring to the exemplary, and therefore non-limiting, embodiments illustrated in the drawings, wherein like reference numbers (if they occur in more than one view) designate the same elements. The invention may be better understood by reference to one or more of these drawings in combination with the description presented herein.

DESCRIPTION

The present invention relates to a packing tape dispenser. A preferred embodiment of the present invention will be described hereinafter with reference to the attached drawings.

FIG. 1 is a side view of a packing tape dispenser 100 according to an embodiment of the present invention. The packing tape dispenser 100 includes an upper part 102 and a lower part 130. A rear end of the lower part 130 is fastened to a rear end of the upper part 102 by exemplary screws 140. As shown in FIG. 1, the rear end of the upper part 102 has a slanted surface 145, so that the naturally straight lower part 130 and the upper part 102 forms an angle and maintains a gap between their respective front ends. A piece of tape 156 with an adhesive surface facing downward can then be threaded through the gap. In some embodiments, the lower part 130 has a bend, so that the upper part 102 do not need to have a slanted surface and there is still a gap between the front ends of the upper part 102 and the lower part 130.

Referring again to FIG. 1, the upper part 102 has a concave space 106 with a recessed cutting blade 110 mounted therein. Without exerting out of the concave space 106, the cutting blade 110 does not come into contact with the tape 156 while applying the tape 156 to packages. The concave space 106 and the cutting blade 110 are situated near a front end of the upper part 102. The upper part 102 also includes a removable pin 120 situated near the rear end thereof. When the removable pin 120 is pushed in the upper part 102 and goes through a middle space 152 of the roll of tape 150, the packing tape dispenser 100 is locked to the roll of tape 150. When the removable pin 120 is pushed out of the upper part 102, the packing tape dispenser 100 is unlocked from the roll of tape 150, and a new roll of tape can be installed. In embodiments, the removable pin 120 is secured to the upper part 102, which is made of a rigid material such as plastic or wood, by friction or by screws (not shown).

Referring again to FIG. 1, the lower part 130 has two protruding strips 134 and 138 situated in a front end thereof. According to an embodiment, the elongated lower part 130 is elastic and made of a material such as stainless steel or plastic. When the front end of the lower part 130 is pushed upwards, the protruding strips 134 and 138 approaches the cutting blade 110 which is positioned in a gap between the protruding strips 134 and 138, i.e., a part of or the entire cutting blade 110 is sandwiched between the protruding strips 134 and 138 yet without touching each other. When the front end of the lower part 130 is pulled downwards, the tape 156 can be more easily accessed by fingers.

Figure 2A:
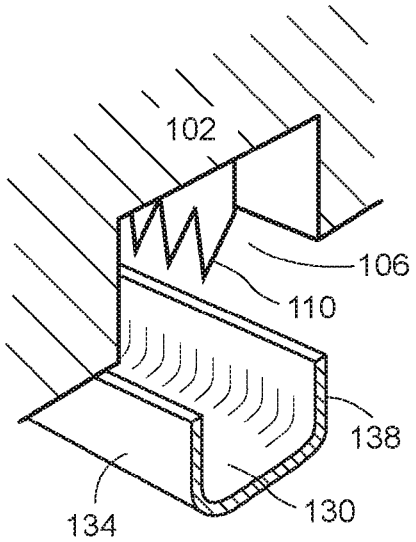
FIGS. 2A and 2B are cross-sectional views illustrating a cutting mechanism of the packing tape dispenser of FIG. 1.
Figure 2B:
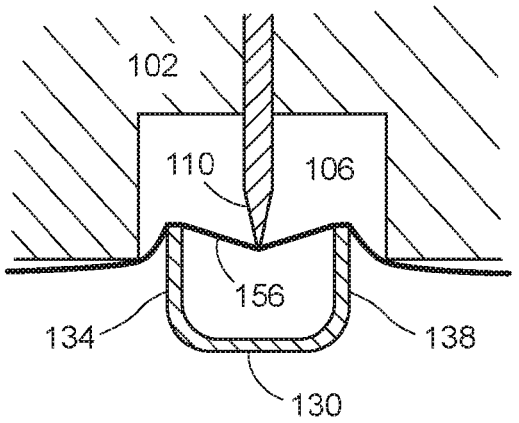

FIGS. 2A and 2B are cross-sectional views illustrating a cutting mechanism of the packing tape dispenser 100 of FIG. 1. As shown in FIGS. 2A and 2B, the cutting blade 110 has serrated lower edge recessed within the concave space 106, so that the cutting blade 110 does not normally come into contact with the tape 156. The cutting blade 110 is unmovable relative to the upper part 102. The protruding strips 134 and 138 of the lower part 130 form side walls of a groove. During a tape cutting operation, the front end of the lower part 130 is pushed upward, so that the groove comes to pocket at least the lower edge of the cutting blade 110, i.e., at least the serrated lower edge of the cutting blade 110 is lower than an upper edge of at least one of the protruding strips 134 and 138. Because the adhesive side of the tape 156 is facing downward, the tape 156 adheres to the upper edges of the protruding strips 134 and 138 and is stretched between them. Then during the tape cutting operation, the cutting blade 110 perforates and cuts the stretched and upwardly moving tape 156. When the front end of the lower part 130 is released, spring force thereof urges the front end of the lower part 130 to move downward and leave a gap between the front end of the upper part 102 and the front end of the lower part 130, so that the tape 156 can be reached and threaded through the gap. As shown in FIG. 2B, the concave space 106 has enough space between the cutting blade 110 and internal side walls of the concave space 106 to allow the protruding strips 134 and 138 to be freely moved up to pocket the cutting blade 110.

Figure 3:
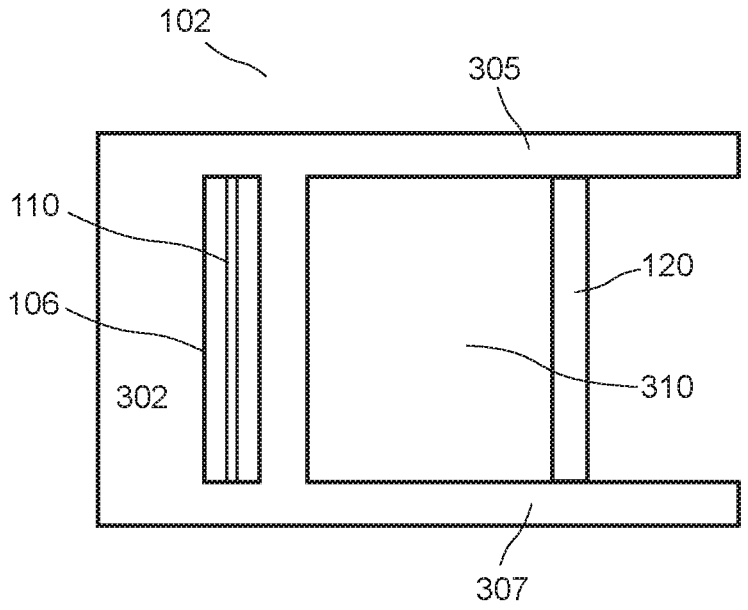
FIG. 3 is a bottom view of an upper part of the packing tape dispenser of FIG. 1.

FIG. 3 is a bottom view of an upper part 102 of the packing tape dispenser 100 of FIG. 1. The bottom view illustrates that the front end of the upper part 102 is a solid part 302 with two parallel side panels 305 and 307 extending rearward. The removable pin 120 is engaged with the side panels 305 and 307. When in place as shown in FIG. 3, the removable pin 120 and the upper part 102 form a closed lope to lock the ring of tape 150 through a space 310.

As shown in FIG. 3, the elongated concave space 106 is formed in the solid part 302. The cutting blade 110 with a width proximately equals to a width of the tape 156 is fastened in approximately the middle of the concave space 106 and is positioned approximately perpendicular to the side panels 305 and 307.

Figure 4:
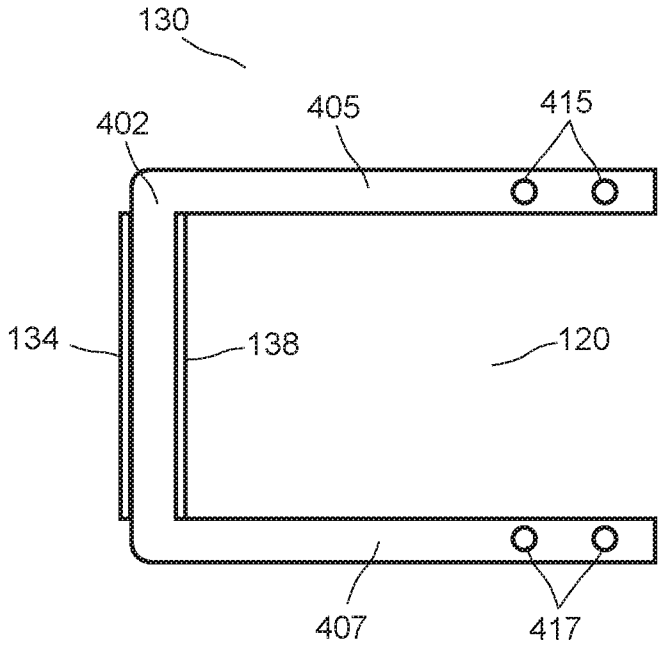
FIG. 4 is a top view of a lower part of the packing tape dispenser of FIG. 1.

FIG. 4 is a top view of the lower part 130 of the packing tape dispenser 100 of FIG. 1. The top view illustrates that the lower part 130 has two side plates 405 and 407 which are connected by a front plate 402. The protruding strips 134 and 138 protrudes upwardly from the front plate 402. In one embodiment, the lower part 130 is formed by stamped sheet metal. In another embodiment, the lower part 130 is formed by injection molding of a plastic material. As shown in FIG. 4, there are openings 415 and 417 on the rear end of the side plates 405 and 407, respectively, for fastening the rear end of the lower part 130 to the upper part 102.

Figure 5A:
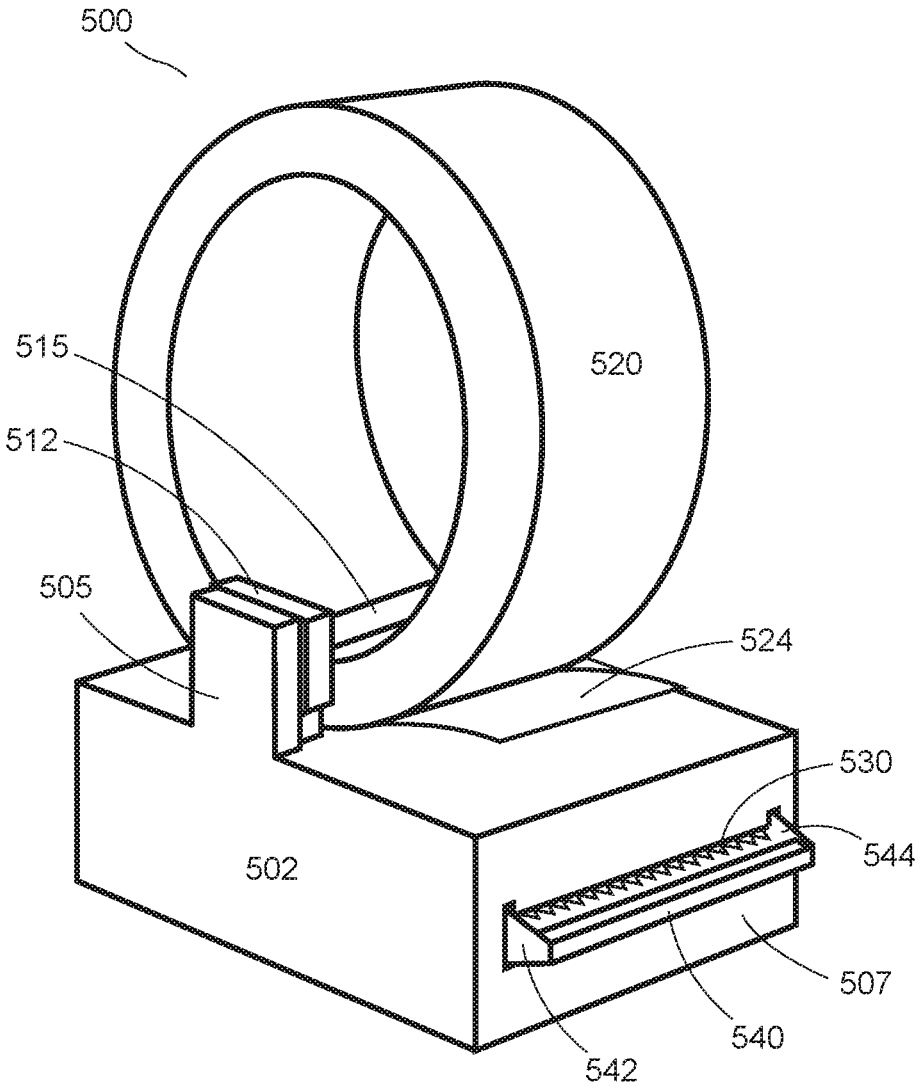
FIGS. 5A and 5B are perspective views of a tape dispenser in accordance with an embodiment of the present invention.
Figure 5B:
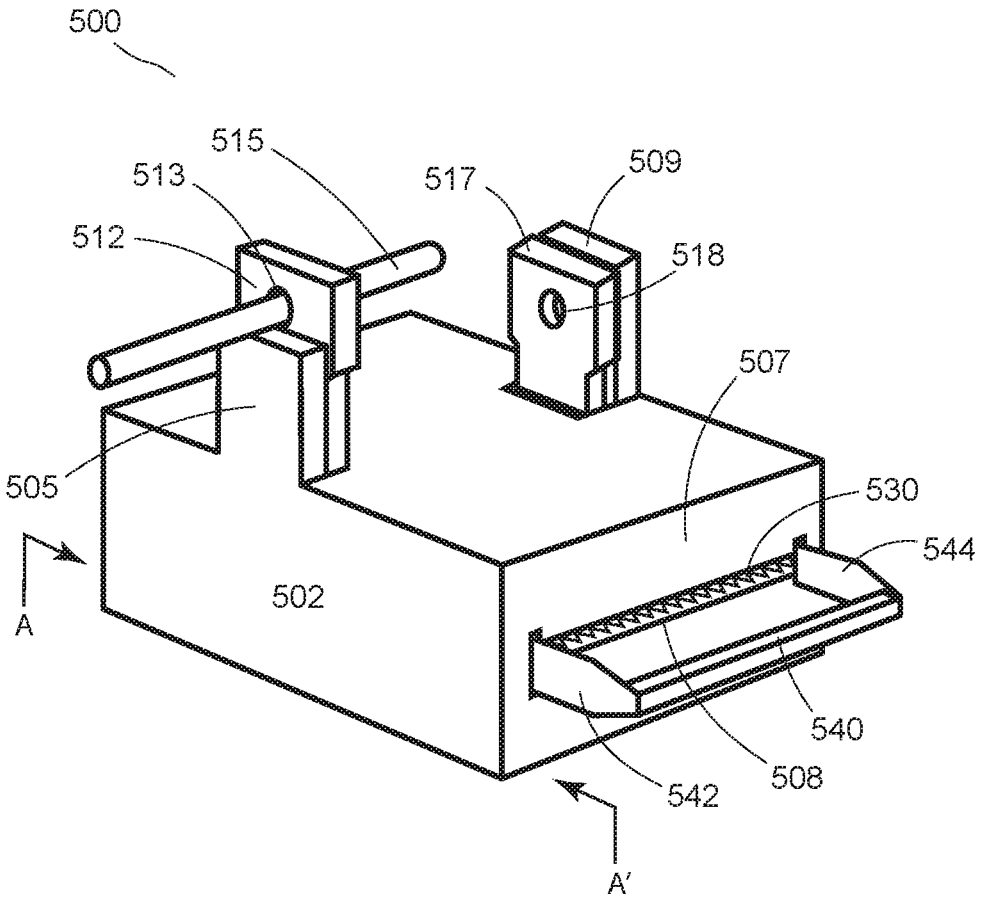

FIGS. 5A and 5B are perspective views of a tape dispenser in accordance with an embodiment of the present invention. Referring to FIG. 5A, a tape dispenser 500 has a rectangular-shaped body 502 that holds a roll of tape 520 on its side and a cutting blade 530 on its bottom 507. The roll of tape 520 is held in place by a rod 515 which in turn is held in place by a fixed plate 505 protruding from the body 502 and a slidable plate 512. Details of tape mounting mechanism will be depicted in subsequent FIG. 6 and associated descriptions.

As shown in FIG. 5A, the roll of tape 520 is mounted in a way that an extracted piece of tape 524 has an adhesive side facing away from the bottom 507 of the body 502 when threaded through a gap between the bottom 507 and a groove member 540. As a part of cutting mechanism, the groove member 540 is slidable and has a cross-section similar to the lower part 130 shown in FIG. 2A. The groove member 540 is attached to two side plate 542 and 544 which can slide in and out of the body 502 in parallel to an elongated direction of the body 502, so that the groove member 540 can slide toward the cutting blade 530 for cutting tape; or slide away from the bottom 507 for threading a piece of tape through a gap between the bottom 507 and the groove member 540.

Referring to FIG. 5B, the groove member 540 is in a slide-out position that leaves a wide gap between the bottom 507 and the groove member 540 so that a piece of tape can be easily threaded through the gap.

Referring again to FIG. 5B, with the roll of tape 520 removed, the tape mounting mechanism is revealed. The plates 505 and 509 protruding from the body 502 are fixed relative to the body 502. The plates 512 and 517 are slidable in an up-and-down direction. The slidable plates 512 and 518 have holes 513 and 518, respectively, to accommodate the rod 515. When ends of the rod 515 are inserted in the holes 513 and 518, respectively, and the slidable plates 512 and 517 are both in a down location, the rod 515 is locked between the fixed plates 505 and 509, so that a roll of tape can be retained by the rod 515. As shown in FIG. 5B, when the slidable plate 512 is raised with the hole 513 situated above the fixed plate 505, the rod 515 can then be pulled out of the hole 518 and slide toward the left hand side, so that a roll of tape can be either removed from or inserted under the rod 515.

Figure 6A:
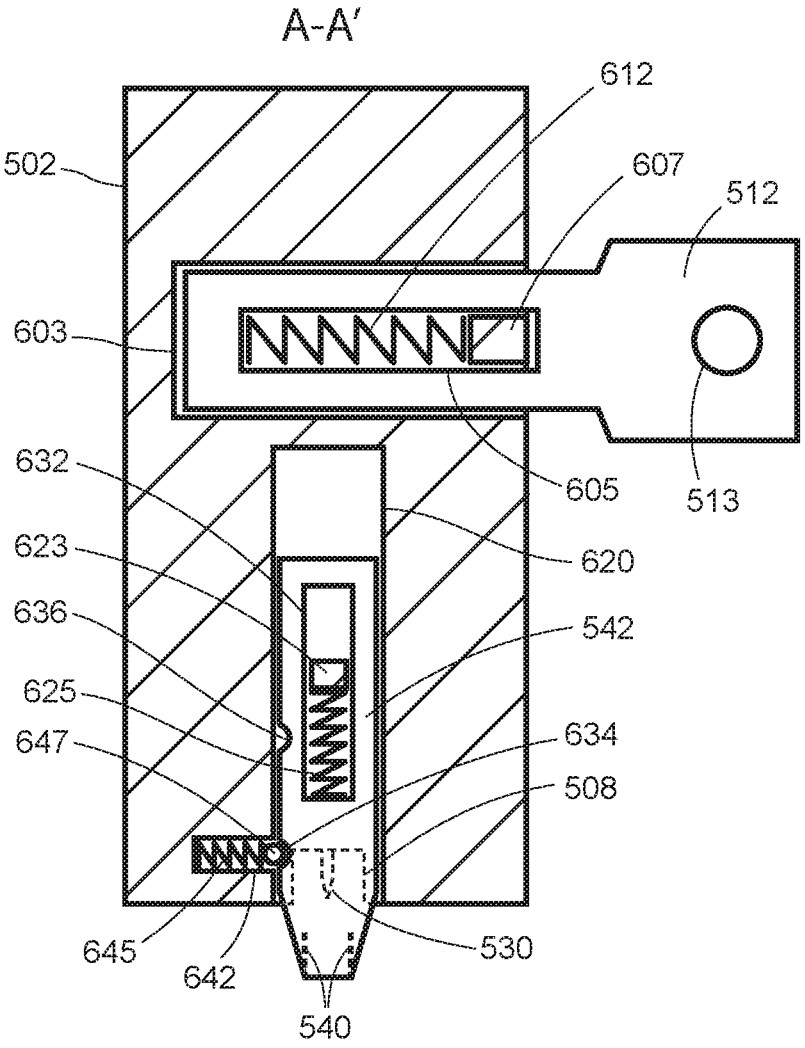
FIGS. 6A-6C are cross-sectional views of the tape dispenser shown in FIGS. 5A and 5B.
Figure 6B:
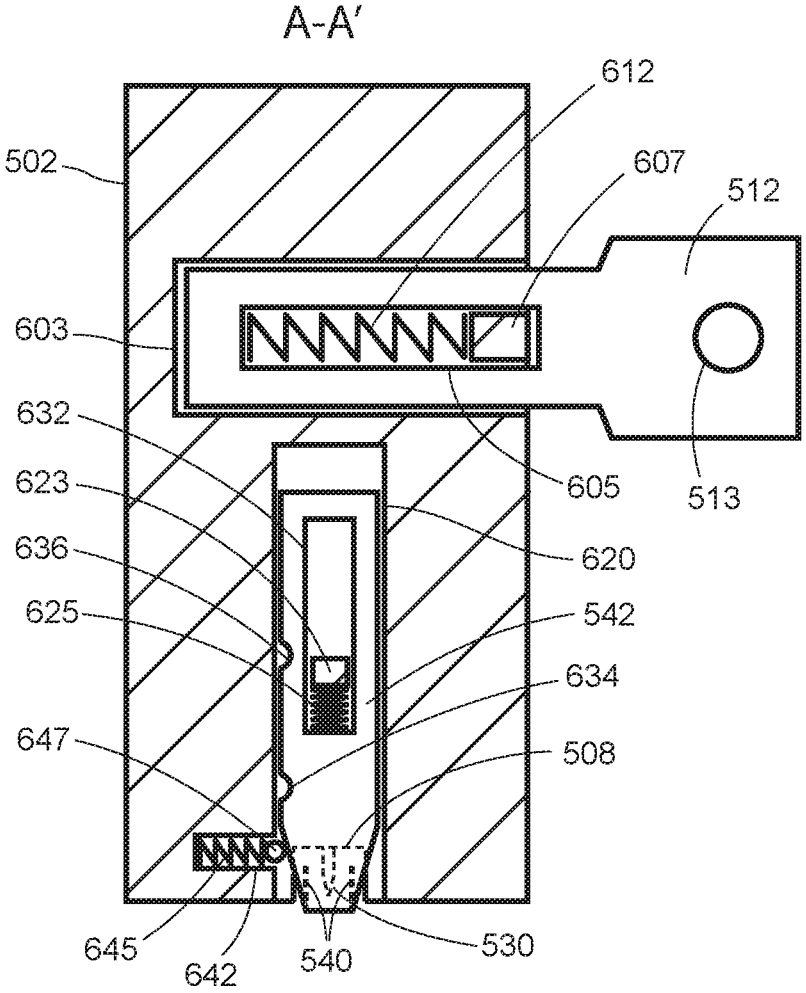
Figure 6C:
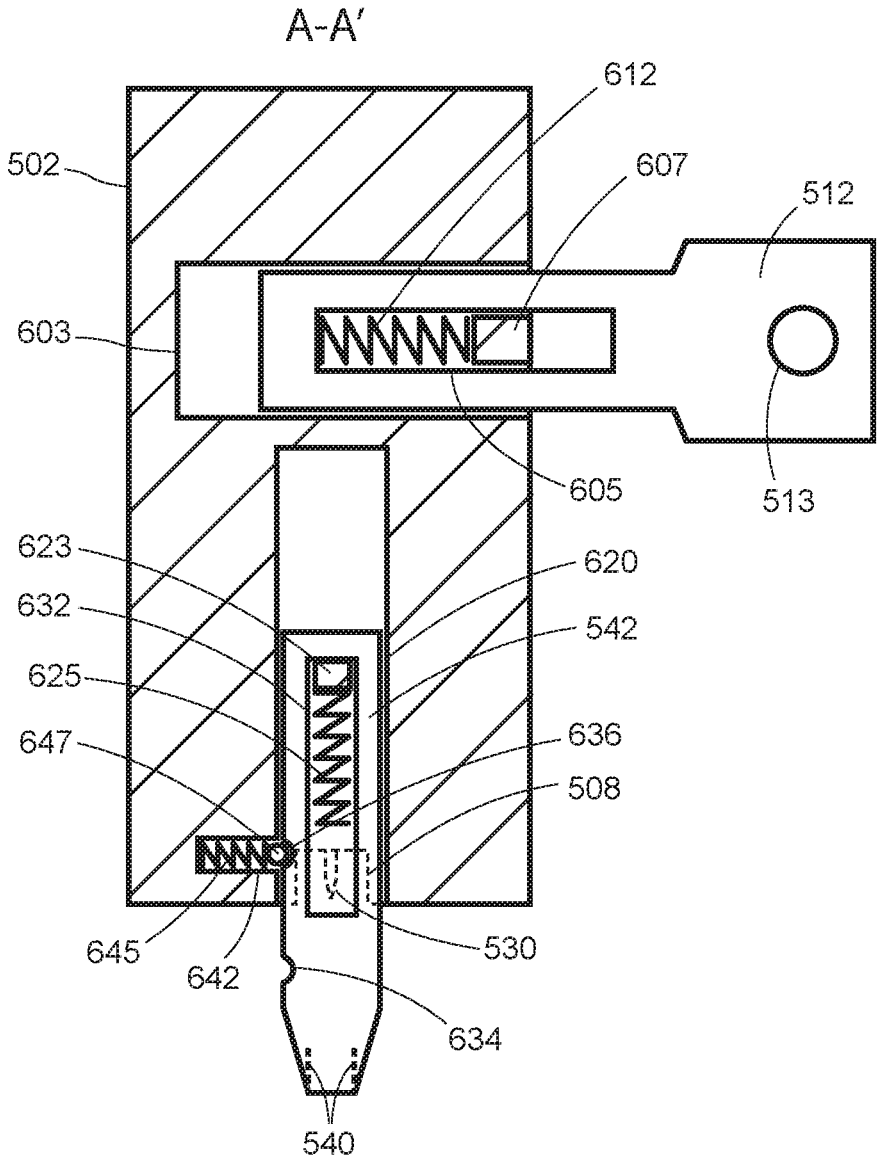

FIGS. 6A-6C are cross-sectional views of the tape dispenser at an A-A' location shown in FIG. 5B. Referring to FIG. 6A, the body 502 has a first hollowed space 620 to accommodate the side plate 542 which can slide up and down therein. The side plate 542 has a slot 632 to retain a spring 625. Also within the second hollowed space 620, there is a stopper 623 fixed to the body 502. The stopper 623 stops the spring 625 from moving upward. The stopper 623 also prevents the side plate 542 from being completely pulled out of the body 502.

Referring again to FIG. 6A, the body 502 has a second hollowed space 642 to retain a spring 645 and a pin 647. The spring 645 urges the pin 647 toward the side plate 542. When a notch 634 on the side plate 542 coincides with the pin 647, the side plate 542 is kept at a predetermined location as shown in FIG. 6A. In this location, the tape dispenser 500 is in a ready state to apply a piece of tape on an object and to cut the tape when desired. However, the urge of the spring 645 can be overcome by forcing the side plate 542 to slide vertically.

Referring again to FIG. 6A, the body 502 has a third hollowed space 603 to accommodate the slidable plate 512 which has a slot 605 to retain a spring 612. A stopper 607 fixed to the body 502 is also situated in the slot 605 to block one end of the spring 612 from moving outside of the body 502. In doing so, the stopper 607 also prevents the slidable plate 512 from being completely pulled out the body 502. The spring 612 then urges the slidable plate 512 toward the body 502, so that in an unforced state, the slidable plate 512 is in an inward position for retaining the rod 515 between the fixed plates 505 and 509 (see FIGS. 5A and 5B). The slot 605 also has space to allow the slidable plate 512 to be partially pulled out—with the spring 612 compressed (see FIG. 6C below), for removing the rod 515 from the hole 513 (see FIG. 5B).

Referring to FIG. 6B, when the body 502 is pushed down against an object, the side plate 542 slides upward with the groove member 540 partially submerged in a concave space 508 in the body 502 and pocketing the cutting blade 530. If a piece of tape is threaded between the body 502 and the groove member 540, such pushing down operation cuts the tape as illustrated in FIG. 2B. When the pushing down force is removed, the spring 625 urges the side plate 542 to slide downward to the location shown in FIG. 6A. Because the adhesive side of the tape is facing downward, after a cutting operation, a remaining tape is glued to the groove member 540 which prevents it from sticking back to the roll. When the groove member 540 is pulled out, so is the remaining tape. This feature makes reloading tape easy.

Referring to FIG. 6C, the side plate 542 is pulled further downward to provide a wider gap between the body 502 and the groove member 540 so that a piece of tape can be easily threaded through the gap.

Referring again to FIG. 6C and FIG. 5B, the slidable plate 512 is also pulled out against the urge of the spring 612. In this location, the hole 513 does not overlap with the fixed plate 505, so that the rod 515 can be removed from the hole 518 for leaving a gap for removing or reloading a roll of tape.

Referring back to FIG. 5B, although the cross-section location A-A' is at one side the body 502, according to embodiments of the present invention, the body 502 has a symmetrical structure, i.e., the side plates 542 and 544 are symmetrical arranged, and so are the fixed plates 505 and 509 and the slidable plates 512 and 517.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A tape dispenser comprising:

A body having a downward facing concave space at a bottom thereof;

a cutting blade mounted to the body and positioned in the concave space with an cutting edge recessed in the concave space;

a groove member being able to move vertically between a first and second location, at the first location, the groove member being partially submerged in the concave space and pocketing at least a portion the cutting blade for cutting a piece of tape, at the second location, the groove member being downwardly away from the bottom of the body for threading a piece of tape through a gap formed between the groove member and the bottom of the body;

a side plate attached to an end of the groove member, the side plate being slidably accommodated in a first hollowed space formed inside the body, the side plate having a first slot for retaining a first spring to urge the side plate to slide downwardly resulting in the groove member to move from the first location to the second location; and a first stopper situated within the first slot and at an upper end of the first spring, the first stopper being fixed to the body and preventing the side plate from being completely pulled out of the first hollowed space.

2. The tape dispenser of claim 1, wherein the cutting blade has a serrated cutting edge.

3. The tape dispenser of claim 1, wherein the groove member has a U-shaped cross-section.

4. The tape dispenser of claim 1 further comprising a spring loaded pin contained inside the body and a first notch on an edge of the side plate, wherein the groove member is maintained in the second location by engaging the spring loaded pin with the first notch.

5. The tape dispenser of claim 4, wherein the groove member can be pulled to a third location further down from the second location.

6. The tape dispenser of claim 5 further comprising a second notch on the edge of the side plate, wherein the groove member is maintained in the third location by engaging the spring loaded pin with the second notch.

7. The tape dispenser of claim 1 further comprising a holding plate slidably accommodated in a second hollowed space in the body and a second spring urging the holding plate to slide from a fourth location to a fifth location, the holding plate having a hole for holding a removable rod to retain a roll of tape.

8. The tape dispenser of claim 7 further comprising a fixed plate protruding from the body, when the holding plate is at the fifth location, the fixed plate overlaps the hole so that an end of the rod is held within the hole, and when the holding plate is at the fourth location, the hole is unblocked so that the rod can be removed from the hole.

9. The tape dispenser of claim 7 further comprising a second stopper fixed to the body for preventing the second spring and the holding plate from completely sliding out of the body.

10. A tape dispenser comprising:

A body having a downward facing concave space at a bottom thereof;

a cutting blade mounted to the body and positioned in the concave space with an cutting edge recessed in the concave space;

a groove member being able to move vertically between a first and second location, at the first location, the groove member being partially submerged in the concave space and pocketing at least a portion the cutting blade for cutting a piece of tape, at the second location, the groove member being downwardly away from the bottom of the body for threading a piece of tape through a gap formed between the groove member and the bottom of the body;

a side plate attached to an end of the groove member, the side plate being slidably accommodated in a first hollowed space formed inside the body, the side plate having a first slot for retaining a first spring to urge the side plate to slide downwardly resulting in the groove member to move from the first location to the second location;

a first stopper situated within the first slot and at an upper end of the first spring, the first stopper being fixed to the body and preventing the side plate from being completely pulled out of the first hollowed space; and a spring loaded pin contained inside the body and a first notch on an edge of the side plate, wherein the groove member is maintained in the second location by engaging the spring loaded pin with the first notch.

11. The tape dispenser of claim 10, wherein the cutting blade has a serrated cutting edge.

12. The tape dispenser of claim 10, wherein the groove member has a U-shaped cross-section.

13. The tape dispenser of claim 12, wherein the groove member can be pulled to a third location further down from the second location.

14. The tape dispenser of claim 13 further comprising a second notch on the edge of the side plate, wherein the groove member is maintained in the third location by engaging the spring loaded pin with the second notch.

15. The tape dispenser of claim 10 further comprising a holding plate slidably accommodated in a second hollowed space in the body and a second spring urging the holding plate to slide from a fourth location to a fifth location, the holding plate having a hole for holding a removable rod to retain a roll of tape.

16. The tape dispenser of claim 15 further comprising a fixed plate protruding from the body, when the holding plate is at the fifth location, the fixed plate overlaps the hole so that an end of the rod is held within the hole, and when the holding plate is at the fourth location, the hole is unblocked so that the rod can be removed from the hole.

17. The tape dispenser of claim 15 further comprising a second stopper fixed to the body for preventing the second spring and the holding plate from completely sliding out of the body.

* * * * *